United States Patent [19]

Ellis et al.

[11] Patent Number: 4,916,312

[45] Date of Patent: Apr. 10, 1990

[54] DEVICE FOR PLACING A RADIOACTIVE SOURCE IN A FORMATION THROUGH WHICH A BOREHOLE PASSES

[75] Inventors: Ian C. Ellis, Stavanger, Norway; Fernand Fourcade, Estagel; Patrick Vandenabeele, Clamart, both of France

[73] Assignee: Schlumberger Technology Corporation, New York, N.Y.

[21] Appl. No.: 164,254

[22] Filed: Mar. 4, 1988

[30] Foreign Application Priority Data

Mar. 5, 1987 [FR] France ..... 87 02974

[51] Int. Cl.[4] ..... G01V 5/00

[52] U.S. Cl. ..... 250/260; 89/1.15; 250/259

[58] Field of Search ..... 250/256, 259, 260; 175/4.54, 4.58; 102/308, 319, 323, 324; 89/1.15

[56] References Cited

U.S. PATENT DOCUMENTS

| | | | |
|---|---|---|---|
| 2,218,802 | 10/1940 | McCullough | 175/4.56 |
| 2,308,006 | 1/1943 | Hendrickson | 175/4.58 |
| 2,327,141 | 8/1943 | Spencer | 175/4.54 |
| 2,328,247 | 8/1943 | Alexander | 175/4.58 |
| 2,328,308 | 8/1943 | Turechek | 175/4.58 |
| 2,340,966 | 2/1944 | Kitsman | 175/4.55 |
| 2,565,788 | 8/1951 | Tow | 175/4.58 |
| 2,592,434 | 4/1952 | Krassnow | 102/513 |
| 3,367,429 | 2/1968 | Porter | 175/4.58 |
| 3,419,089 | 12/1968 | Venghiattis | 175/4.57 |
| 4,185,702 | 1/1980 | Bullard | 175/4.54 |

*Primary Examiner*—Constantine Hannaher

*Attorney, Agent, or Firm*—Clifford L. Tager

[57] ABSTRACT

The present invention relates to a device for placing a radioactive source into a formation through which a borehole passes. The device includes a gun barrel, a bullet containing a radioactive source and engaged in the barrel, and an explosive device for propelling the bullet towards the formation. The device further includes two items which reduce the speed at which the bullet, when fired, penetrates into the formation. These items are a spacer, placed in the barrel between the bullet and the explosive device, and a braking shield placed at the port end of the barrel. The spacer reduces the effect of the gases produced by the explosive device upon detonation. The braking shield is entrained with the fired bullet, the front end of the shield producing drag which also acts to retard the forward propulsion of the bullet. The shield is designed to break away from the bullet upon formation impact, further reducing the kinetic energy of the bullet. The invention is applicable to soft formations.

18 Claims, 1 Drawing Sheet

DEVICE FOR PLACING A RADIOACTIVE SOURCE IN A FORMATION THROUGH WHICH A BOREHOLE PASSES

BACKGROUND OF THE INVENTION

1. Technical Field

The present invention relates to a device for use in a borehole to place a radioactive source in one of the geological formations through which the borehole passes. Such an operation is a preliminary operation prior to measuring formation subsidence. Sources put into place in this way serve as tracers whose depths are measured by means of radiation detectors lowered down the borehole. Subsidence is determined by evaluating the variation over time of the depths of the sources.

2. Background Information

A source is conventionally put into place by firing a radioactive bullet, i.e. a bullet containing a radioactive source, into the formation using an explosive device (referred to as a "gun" by the person skilled in the art) suitable for being moved along a borehole.

For the source to be put into place in satisfactory manner, the distance by which it penetrates into the formation from the borehole must lie within a determined range. If it does not penetrate far enough, there is a danger of the radioactive bullet falling into the borehole and contaminating the fluids therein. Conversely, if it penetrates too far, it may be impossible to detect the radioactivity coming from the bullet by means of a detector lowered down the borehole, particularly if the formation has a high level of natural radioactivity.

Naturally, penetration depends on the hardness of the formation into which the shot is fired. The problem is particularly difficult in very soft formations, such as chalk. The penetration distance can be varied by varying the amount of explosive, however to limit penetration adequately in a very soft formation it would be necessary to reduce the amount of explosive to such an extent that bullet firing is no longer certain.

The invention seeks to place a radioactive bullet at a suitable penetration distance, even in very soft formations.

SUMMARY OF THE INVENTION

The present invention provides a device for putting a radioactive source into a formation through which a borehole passes, the device comprising a gun barrel a bullet containing radioactive source and engaged in the barrel, and explosive means for propelling the bullet towards the formation, the device being characterized in that it additionally includes means for reducing the speed with which the bullet penetrates into the formation when it is fired.

A preferred method of reducing the penetration speed of the bullet consists in placing a tubular spacer member in the barrel behind the bullet, thereby reducing the distance travelled by the bullet along the barrel, and thus reducing the initial speed of the barrel.

In addition, the tubular spacer member may be shaped to provide an expansion chamber behind the bullet for the gases evolved by the explosion, thereby reducing the propulsive pressure exerted on the ballet and thus contributing to the reduction in the initial speed of the bullet.

Another means for reducing the speed of the bullet, which is advantageously combined with the above-mentioned means, consists in placing a shield-shaped item over the muzzle of the gun barrel and disposed to be entrained by the bullet when fired, thereby slowing down the bullet as it moves through the drilling fluid.

BRIEF DESCRIPTION OF THE DRAWINGS

The invention will be better understood from reading the following description of an embodiment. In the drawing.

DESCRIPTION OF THE PREFERRED EMBODIMENT(S)

Figure 1:
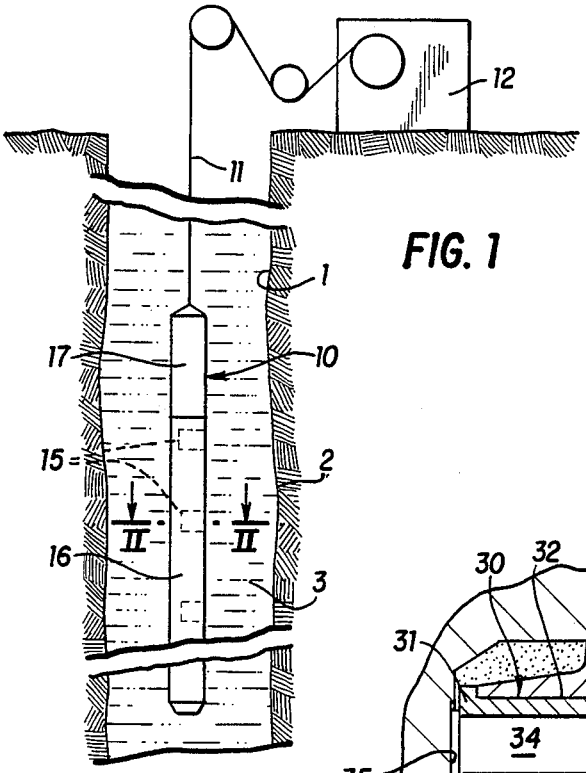
FIG. 1 is a diagram of a device for putting radioactive bullets into place.

FIG. 1 shows a borehole 1 passing through geological formations 2. The borehole is filled with a fluid 3 such as drilling mud.

Prior to performing formation subsidence measurements, radioactive sources are placed at determined depths by means of a device 10 referred to as a "gun", which device is lowered down the borehole 1 by means of an electric cable 11 which also serves to transmit electrical signals between the gun 10 and surface equipment represented by box 12.

The gun 10 comprises a plurality of modules 15 fixed on an elongate rigid support 16, with each module serving to fire one radioactive bullet into the formation. The top of the gun 10 has an electronics portion 17 which is connected to the cable 11 and which applies firing signals to the modules 15 in response to control messages sent from the surface equipment 12.

Figure 2:
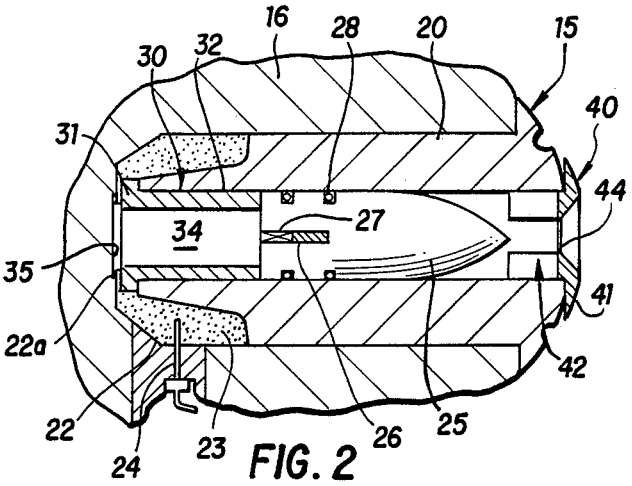
FIG. 2 is a cross-section on line II—II of FIG. 1 through a module in accordance with the invention for firing a bullet.

Each module, as shown in greater detail in FIG. 2, comprises a barrel 20 which is substantially tubular in space and which is fixed in a support housing 16, e.g. by screwing. The rear end of the barrel tapers down and is surrounded by a cartridge 22 containing explosive 23, with the cartridge being in the form of two concentric portions which are fixed to each other by an eyelet **22*a* after it has been filled with explosive. A detonator 24 penetrates into the cartridge, with the detonator 24 being connected to an electric circuit (not shown) received in the support 16 and connected to the electronics portion 17** of the gun.

A bullet 25 is placed in the barrel 20 with the front end of the bullet being bullet shaped. The rear end of the bullet is provided with a housing which receives a radioactive pellet 26, for example a 100 $\mu$Ci cesium source 137. The pellet 26 is held in its housing by a plug 27. O-rings 28 are received in grooves formed in the rear portion of the bullet 25 in order to provide sealing against the drilling fluid.

It is mentioned in the introduction to the present application that the distance the bullet penetrates into the formation should neither be too far (so that the radiation can still be detected during subsequent subsidence measurements), nor too near (to avoid any risk of the bullet dropping down the borehole), with the optimum penetration distance being about 20 cm from the wall of the borehole. For hard or average formations, the penetration distance is adjusted by varying the amount of explosive, i.e. by varying the degree to which the cartridge is filled. However, it is not possible to go below a minimum weight of 5 grams (g) since there is a danger of misfiring if less than 5 g of explosive are used. However, if the formation is soft, the bullet penetration distance, even when fired with the minimum quantity of explosive, is too far. The means described below serve to reduce the bullet penetration distance.

A tubular spacer member 30 is mounted in the rear portion of the barrel 20. The spacer 30 has a flange 31 at its rear end whose outer diameter is greater than the inside diameter of the barrel 20, and this flange comes into abutment against the rear face of the barrel. The outside diameter of the portion 32 of the spacer which is engaged inside the barrel is slightly less than the inside diameter of the barrel in order to allow the spacer to be inserted therein. The bullet 25 is in abutment against the front end of the spacer 30. The tubular shape of the spacer 30 defines a chamber 34 between the rear end of the bullet 25 and the closed end 35 of the housing in which the module 15 is received. This chamber allows the gases evolved by the explosion to expand, thereby reducing the pressure exerted on the rear end of the bullet 25 and consequently reducing the initial speed of the bullet 25. In addition, by virtue of the spacer 30, the bullet 25 is located in a more forward position along the barrel than in the prior art, and as a result, when it is fired, it travels inside the barrel along a distance which is reduced by the length of the spacer 30. This also tends to reduce the initial speed of the bullet, with this effect adding to the effect due to the gases expanding.

Figure 3:
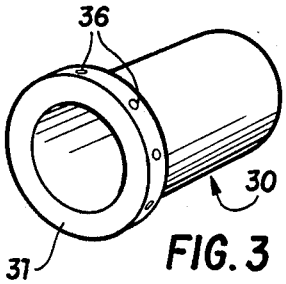
FIG. 3 is a detailed view showing in tubular spacer member.

The perspective view of FIG. 3 shows that the flange 31 includes a series of radial holes 36 which serve as vents for the explosion gases. If such vents were absent, the explosion would have the effect of forcing the spacer forwardly along the barrel by crushing the flange 31 in the radial direction. The spacer would then be jammed in the barrel and very difficult to extract, in addition the bore of the barrel would be damaged and the firing module could not be used for a subsequent operation.

Figure 4:
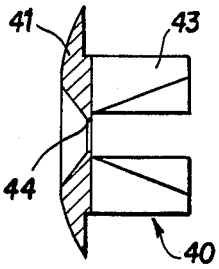
FIG. 4 is a detailed view showing the braking shield.

FIG. 2 shows an additional device for limiting bullet penetration in a formation, which device is shown in greater detail in FIG. 4. The device may be used simultaneously with the spaoer 30. This device is a braking item 40 which is suitable for being placed in the muzzle of the barrel 20. The item 40 comprises a generally shield-shaped portion 41 placed outside the barrel 20 and pressing against the front end face thereof, together with a skirt 42 engaged in the bore of the barrel. The skirt 42 is in the form of a plurality of tongues 43 occupying sectors of a cylinder, for example four outside sectors as shown in FIG. 4, with the sectors being connected to a central portion. This shape provides axial break lines which makes it easier for the shield to split into pieces on striking the formation. The outside diameter of the tongues 43 is suitable for allowing the skirt to slide into the barrel, with the item 40 being held against the front end face of the barrel, in operation, by the pressure of the drilling fluid.

The shield 41 has a central opening 44 into which the pointed front end of the bullet 25 penetrates when it is fired. In addition, the inside shape of the tongues 43 is tapering with an inside diameter that becomes smaller going forwards, thereby obtaining a shape which is similar to the bullet shaped front end of the bullet. This makes it easier for the bullet to entrain the shield when the bullet is fired. The item 40 mounted on the bullet in this way acts like a parachute as the bullet moves through the drilling fluid, thereby slowing it down. In addition, on striking the formation, a portion of the kinetic energy of the bullet is absorbed in breaking the item 40, thus further reducing its penetration distance into the formation.

The FIG. 2 module is assembled by initially engaging the radioactive bullet 25 into the barrel 20 via its rear opening, then engaging the tubular spacer 30 into the barrel thus pushing the bullet forwards along the barrel until the flange 31 comes into abutment against the rear end of the barrel. A cartridge 22 is then placed around the rear end of the barrel and the module 15 is screwed into the support 16. The item 40 can then be placed in the muzzle of the barrel.

If some of the shots are to be fired into hard formations, there is no need to fit all of the modules 15 with tubular spacers and shields. For firing into a hard formation the bullet 25 is located at the rear end of its barrel so that its rear face comes into contact with the closed end face 35 of the housing in which the firing module is received.

Naturally the invention is not limited to the embodiment described and shown above, and numerous modifications may be made thereto by the persons skilled in the art without going beyond the scope of the invention.

What is claimed is:

1. A device for firing a radioactive source into a formation through which a borehole passes, said device comprising:

a gun barrel;

a bullet having a radioactive source and engaged in said barrel;

explosive means located behind said bullet to propel said bullet towards the formation upon detonation of said explosive means; and retarding means located between said explosive means and said bullet, said retarding means including a chamber having sufficient volume so as to enable gases produced by said explosive means upon detonation to expand, thereby reducing the impact of said gases on said bullet and retarding the speed at which said bullet penetrates into the formation upon detonation of said explosive means

2. The device according to claim 1, wherein said retarding means comprises a tubular spacer at least partially located within said barrel behind said bullet, said tubular spacer providing said chamber, said retarding means further comprising a retaining flange in abutment against the rear end of said barrel.

3. The device according to claim 2, wherein said retaining flange includes a radially directed vent in fluid communication with said chamber.

4. The device according to claim 1, said device further including a braking shield disposed on said barrel and arranged to be entrained by said bullet upon propulsion of said bullet by detonation of said explosive means.

5. The device according to claim 4, wherein said braking shield includes a skirt engaged in said barrel, said skirt including a plurality of separate tongues.

6. The device according to claim 5, wherein the inside diameter of each of said tongues is tapered.

7. The device according to claim 4, wherein said braking shield includes a central opening arranged to receive the front end of said bullet upon propulsion of said bullet by detonation of said explosive means.

8. A device for use in a borehole for firing a bullet containing a radioactive source into a formation through which a borehole passes, said device comprising:

a tubular spacer having first and second terminal ends and an internal chamber, the bullet containing the radioactive source to abut said second terminal end;

a cartridge surrounding the first terminal end of said tubular spacer, said cartridge including an explosive device and a detonator therefor, said spacer providing said internal chamber having sufficient volume so as to enable gases produced by said explosive device upon detonation to expand, thereby reducing the impact of said gases on the bullet; and a barrel surrounding the second terminal end of said tubular spacer, said barrel constructed to receive the bullet containing the radioactive source, said barrel having a port to allow the bullet to exit therethrough upon detonation of said explosive device.

9. The device of claim 8, said tubular spacer including a flange at its first terminal end, said flange causing the first terminal end of said spacer to remain outside of said barrel upon detonation of said explosive device.

10. The device of claim 9, said flange including at least one vent in fluid communication with the internal chamber of said spacer to allow at least a portion of the gasses produced by said explosive device upon detonation to flow therethrough.

11. The device of claim 10, said device further including a braking shield removeably attached to the port of said barrel to reduce the forward propulsion of the bullet upon detonation of said explosive device.

12. The device of claim 11, said braking shield including a cap having a skirt attached perpendicularly thereto, said skirt having an outside diameter approximately equal to the inside diameter of the port of said barrel for removeable placement therein, whereby the bullet, upon detonation of said explosive device, contacts and entrains said braking shield, thereby reducing the forward propulsion of the bullet.

13. The device of claim 12, said skirt including a plurality of separate tongues.

14. The device of claim 13, wherein the inside diameter of each of said tongues is tapered to receive at least the forward portion of the bullet upon detonation of said explosive device.

15. The device of claim 8, said device further including a braking shield removeably attached to the port of said barrel to reduce the forward propulsion of the bullet upon detonation of said explosive device.

16. The device of claim 15, said braking shield including a cap having a skirt attached perpendicularly thereto, said skirt having an outside diameter approximately equal to the inside diameter of the port of said barrel for removeable placement therein, whereby the bullet, upon detonation of said explosive device, contacts and entrains said braking shield, thereby reducing the forward propulsion of the bullet.

17. The device of claim 16, said skirt including a plurality of separate tongues.

18. The device of claim 17, wherein the inside diameter of each of said tongues is tapered to receive at least the forward portion of the bullet upon detonation of said explosive device.

* * * * *